US005347349A

United States Patent [19]

Sato et al.

[11] Patent Number: 5,347,349

[45] Date of Patent: Sep. 13, 1994

[54] IMAGE FORMING APPARATUS HAVING A PROTECTIVE GATE MEMBER

[75] Inventors: Kenji Sato; Hiroyuki Honda, both of Hachioji, Japan

[73] Assignee: Konica Corporation, Japan

[21] Appl. No.: 87,627

[22] Filed: Jul. 2, 1993

[30] Foreign Application Priority Data

Jul. 21, 1992 [JP] Japan ..... 4-051225
Jul. 21, 1992 [JP] Japan ..... 4-194130
Sep. 29, 1992 [JP] Japan ..... 4-260370

[51] Int. Cl.[5] ..... G03G 21/00
[52] U.S. Cl. ..... 355/309; 271/3
[58] Field of Search ..... 355/321, 308, 309; 271/3.1, 278, 3

[56] References Cited

U.S. PATENT DOCUMENTS 4,794,419 12/1988 Shibazaki et al. .
5,061,962 10/1991 Takahashi ..... 355/233
5,168,316 12/1992 Hino et al. ..... 355/309
5,203,552 4/1993 Hoshi et al. ..... 271/9

*Primary Examiner*—R. L. Moses
*Attorney, Agent, or Firm*—Jordan B. Bierman

[57] ABSTRACT

An image forming apparatus is equipped with a manual sheet-feeding device to feed a sheet to an image forming section. The manual sheet-feeding device is mounted on a side of a casing in such an arrangement that a manual sheet-feeding entrance is located at the top of the casing and a manual sheet-feeding passage is extended downwardly from the manual sheet-feeding entrance and connected with a sheet passage at the lower portion of the casing.

3 Claims, 8 Drawing Sheets

IMAGE FORMING APPARATUS HAVING A PROTECTIVE GATE MEMBER

BACKGROUND OF THE INVENTION

The present invention relates to an image recording apparatus equipped with a manual sheet-feeding device such as a copying machine and a printer each being equipped with a manual sheet-feeding device.

With regard to the image recording apparatus mentioned above, there have hitherto been known one wherein, from a sheet-feeding unit containing multiple recording sheets such as a sheet-feeding cassette, the recording sheet is fed out one sheet by one sheet to be subjected to steps of exposure, development and transfer in an image forming means so that a recorded image may be formed on the recording sheet, and one wherein a manual sheet-feeding device is provided so that the recording sheet may be fed manually one sheet by one sheet for forming a recorded image.

In the case of a sheet-feeding unit by means of the former sheet-feeding cassette, there has recently been employed a construction of a front-loading type for drawing out a sheet feeding cassette to the front which offers remarkable effects on the points of improvement in operation and a floor space for installation.

In the case of the latter manual sheet-feeding device, on the other hand, the manual sheet-feeding device is positioned horizontally or obliquely on the side or on the rear side of a main body of the image recording apparatus when viewed from an operator of the apparatus.

In the case of the manual sheet-feeding device mounted on the rear side of the image recording apparatus of a type of operating a sheet-feeding cassette on the front side, a manual sheet-feeding tray is protruded horizontally or obliquely at the lower portion on the rear side of a main body of the image recording apparatus. Therefore, a space for installing the sheet-feeding tray is required on the back side of the apparatus. Further, since the sheet-feeding tray is located at the lower portion on the rear side of the main body of the apparatus and an opening for insertion of a recording sheet is invisible, an operator is required to move to the rear side of the apparatus main body and to move a guide plate for the width of a recording sheet for setting recording sheets, which is troublesome and causes a risk of erroneous operations.

The first object of the invention is to solve the problems mentioned above, save the floor space for installation of an image recording apparatus equipped with a manual sheet-feeding device, improve operations for setting recording sheets in the case of manual sheet-feeding and thereby to prevent erroneous operations.

Because of a narrowed space for installation mentioned above, when foreign matters such as clips, pins, and staples fall from the opening for manual insertion in a sheet-traveling path, an image recording apparatus having a sheet-feeding tray mounted obliquely or vertically on the apparatus main body has had problems such as troubles caused by the foreign matters caught by sheet-feeding rollers in a manual sheet-feeding unit or in a sheet-feeding unit in an image recording apparatus. Or, the problems have been caused by the foreign matters staying in the sheet-traveling path to be troubles of defective recording sheet transport (jam). Further, it has been difficult to remove the aforementioned foreign matters fallen on a manual sheet-feeding device or in a sheet-feeding unit of an image recording apparatus.

The second object of the invention is to solve the problems mentioned above, eliminate the troubles caused by the entry of foreign matters in a manual sheet-feeding device and thereby to secure stable transport of recording sheets and prevent troubles of the apparatus.

When viewing from the other aspect of the invention, when a recording sheet is inserted into a sheet-inlet for manual insertion on the image recording apparatus mentioned above, a sensor detects the recording sheet and the detection information starts recording operations such as copying operations, then the inserted recording sheet is taken into the apparatus and ejected from an ejection outlet after image recording on the recording sheet, thus, the sheet-inlet for manual insertion has an advantage that it can be used for image recording on a sheet of a special size or a specific sheet which is difficult to be set in a sheet-feeding cassette or on a sheet-feeding stand. However, it has a problem that the production cost of an image recording apparatus equipped with a sheet-inlet for manual insertion is high due to a low production quantity caused by poor demand therefor, because it is troublesome to insert a recording sheet one by one.

The invention has been achieved for the purpose of solving the problems mentioned above, an its third object is to provide an image recording apparatus equipped with a sheet-inlet for manual insertion whose production cost can be reduced by the increase of its production quantity, an the sheet-inlet for manual insertion can be frequently used without any troublesome of manual insertion of a recording sheet.

SUMMARY OF THE INVENTION

The image recording apparatus equipped with a manual insertion sheet-feeding device of the invention attaining the first object of the invention is characterized in that the manual insertion sheet-feeding device is mounted on the rear side of the image recording apparatus, a sheet-inlet for manual insertion is provided above the manual insertion sheet-feeding device, a sheet-feeding guide path for manual insertion is formed almost vertically beneath the sheet-inlet for manual insertion, and a sheet-feeding path located at a downstream side of the sheet-feeding guide path is connected with a sheet-feeding path on the main body of the image recording apparatus in an image recording apparatus equipped with a manual insertion sheet-feeding device through which a recording sheet is inserted to be formed thereon with an image.

The manual insertion sheet-feeding device of the invention attaining the second object mentioned above is characterized in that a movable gate member urged to block a sheet-feeding path of the manual insertion sheet-feeding device is provided, the gate member prevents foreign items invading into the sheet-feeding path from advancing and ejects them from the sheet-feeding path, and the gate member is subjected to elastic deformation to retreat by the leading edge of a recording sheet when it passes, and when a recording sheet passes, the leading edge thereof causes elastic deformation of the gate member so that it retreats to open the sheet-feeding path for the recording sheet to pass therethrough, in a manual insertion sheet-feeding device that feeds a recording sheet inserted manually to an image recording apparatus.

Further, the manual insertion sheet-feeding device is characterized in that the mate member is provided with a plane on which a foreign item falls and an outlet for a foreign item is provided in the vicinity of the gate member on the frame of the manual insertion sheet-feeding device.

The third object of the invention is achieved by an image recording apparatus comprising a main body of the image recording apparatus equipped with a recording sheet-inlet for manual insertion and a recording sheet-feeding stand having thereon a recording sheet-holding unit equipped with a sheet-feeding tray and a recording sheet-feeding-out section that feeds out a recording sheet stacked on the sheet-feeding tray one sheet by one sheet, wherein the recording-sheet stand is utilized with the aforementioned main body positioned on the recording sheet-holding unit for feeding the recording sheet fed out from the recording sheet-feeding-out section of the recording sheet-feeding stand into the main body through the recording sheet-inlet for manual insertion mentioned above.

Namely, an image recording apparatus of the invention, when it is a main body thereof alone, is used as an image recording apparatus equipped with a sheet-inlet for manual insertion, and when the main body thereof is placed on a recording sheet-feeding stand as a combination, the image recording apparatus of the invention is used as an image recording apparatus equipped with an automatic sheet-feeding means that feeds in a recording sheet from the recording sheet-feeding stand through the sheet-inlet for manual insertion of the image recording apparatus main body. Therefore, both applications mentioned above cause a production quantity of image recording apparatuses each equipped with a sheet-inlet for manual insertion to be increased, and thereby cause a manufacturing cost to be reduced, and in the case of the image recording apparatus main body alone, the sheet-inlet for manual insertion can be used, while in the case of a combination of the image recording apparatus main body and a recording sheet-feeding stand, the sheet-inlet for manual insertion can be used at a high frequency.

BRIEF DESCRIPTION OF THE DRAWINGS

Each of FIG. 7

DETAILED DESCRIPTION OF THE PREFERRED EMBODIMENT

Figure 1:
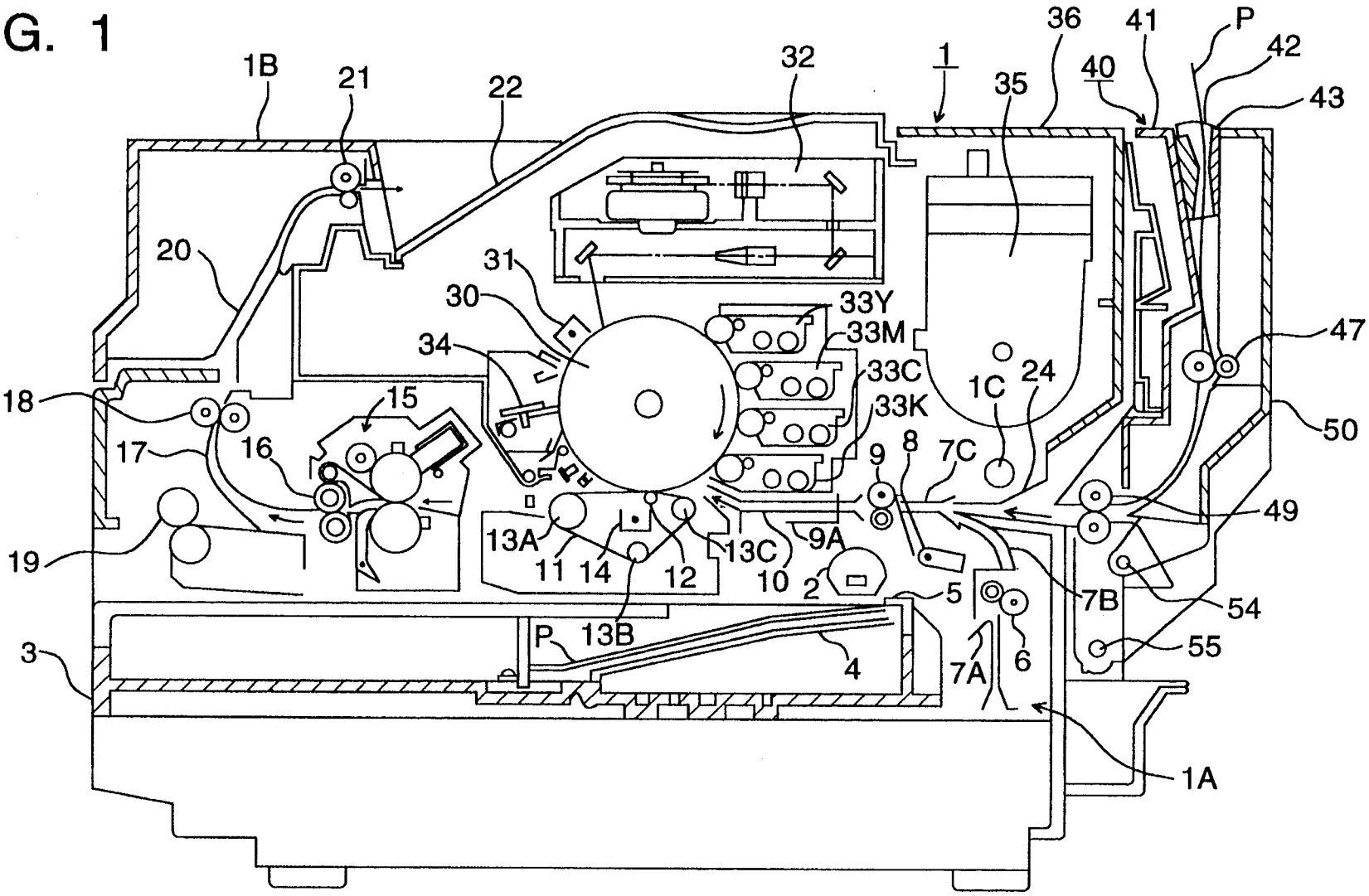
FIG. 1 represents a side sectional view of an image recording apparatus equipped with a manual insertion sheet-feeding device of the invention.

The invention will be explained as follows, referring to the drawings attached hereto.

FIG. 1 represents a side sectional view of an image recording apparatus (color printer) equipped with a manual insertion sheet-feeding device of the invention.

In the FIG. 1A represents a lower framework of the image recording apparatus, and semicircular sheet-feeding roller 2 that feeds recording sheet P is provided in the lower framework 1A, while, sheet-feeding cassette 3 containing a plurality of recording sheets P is provided detachably on the lower framework 1A. In the sheet-feeding cassette 3, there is provided push-up plate 4 which is to be pushed up. The recording sheet P is fed out one sheet by one sheet from the sheet-feeding cassette 3 by means Of the sheet-feeding roller 2 and separation claw 5. The numeral 6 is an intermediate sheet-feeding roller for the recording sheet P provided on the lower framework 1A, and it feeds up the recording sheet P fed by the sheet-feeding roller 2. The intermediate sheet-feeding roller 6 is provided between reversing guide plates 7B.

The symbol 7C is a guide plate for guiding to registration roller 9 the recording sheet P which has been reversed, and it guides the recording sheet P to the registration roller 9. On the upstream side of the registration roller 9 in terms of sheet feeding, there is provided detection sensor 8 for the leading edge of a sheet, while on the downstream side thereof, there is provided movable stopper 9A for the leading edge of a sheet. The numeral 10 is a guide plate which guides the recording sheet P in the direction toward transfer belt 11 after the recording sheet P has passed the registration roller 9. The transfer belt 11 is stretched over pressure roller 12, driving roller 13A and a group of rollers 13B and 13C. The numeral 14 is a transfer electrode, and 15 is a fixing unit for fixing images transferred onto recording sheet P, and it is composed of a heating roller and a pressure roller both are for fixing. The numeral 16 is a sheet-ejecting roller for ejecting the recording sheet P from the fixing unit 15, and ejected recording sheet P is conveyed upward by means of recording sheet-guide member 17 and guide-conveyance roller 180 The numeral 19 is a sheet-ejecting roller for ejecting the recording sheet P out of an apparatus with a recording surface thereof facing upward. The recording sheet P conveyed upward by the conveyance roller 18 is the ejected with its recording surface facing downward, by means of guide path 20 formed on upper framework 1B and sheet-ejection roller 21, onto sheet-ejection tray 22 provided to cover the most part of the entire surface on the top of the upper framework 1B.

Next, photoreceptor drum 30 for image formation is provided rotatably to be driven at the location which is mostly the center of the upper framework 1B. Along the circumferential surface of the photoreceptor drum 30, there are arranged, in the sequence from the upstream side in terms of rotation of the photoreceptor drum, charging electrode 31, laser exposure scanning device 32, four developing units 33Y<33M<33C and 33K each containing different color developer, a transfer means composed of the transfer belt 11 and transfer electrode 14, and cleaning unit 34 that removes remaining toner adhering to the surface of the photoreceptor drum 30 after images thereon have been transferred onto the recording sheet P.

The numeral 35 represents toner supply units supplying color toners and black toner respectively to the developing units 33Y<33M<33C and 33K and fixed on a part of the upper framework 1B. Though only one toner supply unit 35 is illustrated, four units are provided and they supply, for example, cyan toner, magenta toner, yellow toner and black toner respectively to the developing units 33Y, 33M, 33C and 33K for color developing and black developing. The numeral 36 is a cover which causes a part of the upper framework 1B to be opened when fresh color toners are supplied to the toner supply unit 35 from the outside.

The aforementioned is structured so that a conveyance path for recording sheet P may be opened with pivotal shaft 1C as a center. Therefore, when the recording sheet P is conveyed improperly in the course of conveyance, resulting in failure to reach the fixing unit 15, the upper framework 1B can be opened with the pivotal shaft 1C as a center, and the recording sheet P can be taken out.

Figure 2:
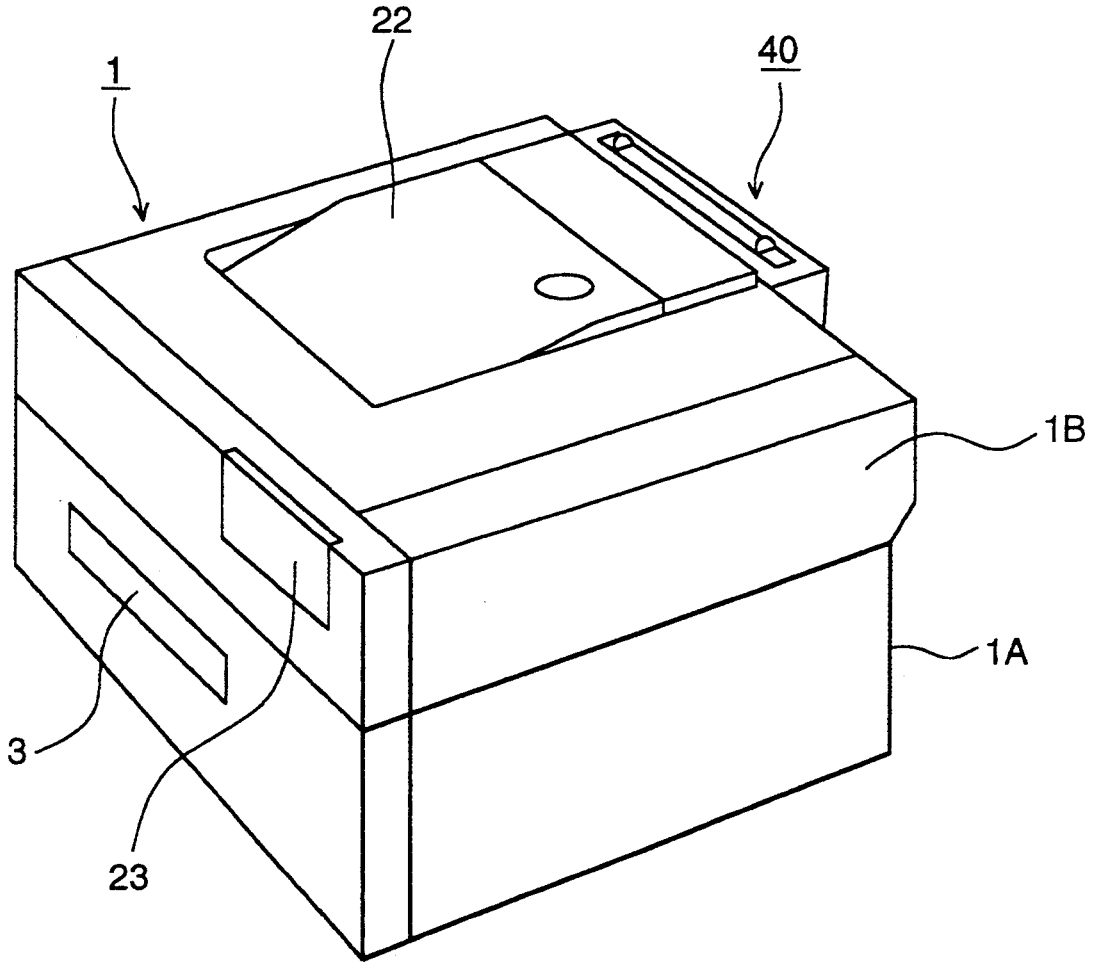
FIG. 2 is a perspective view on the front side of the image recording apparatus mentioned above.
Figure 3:
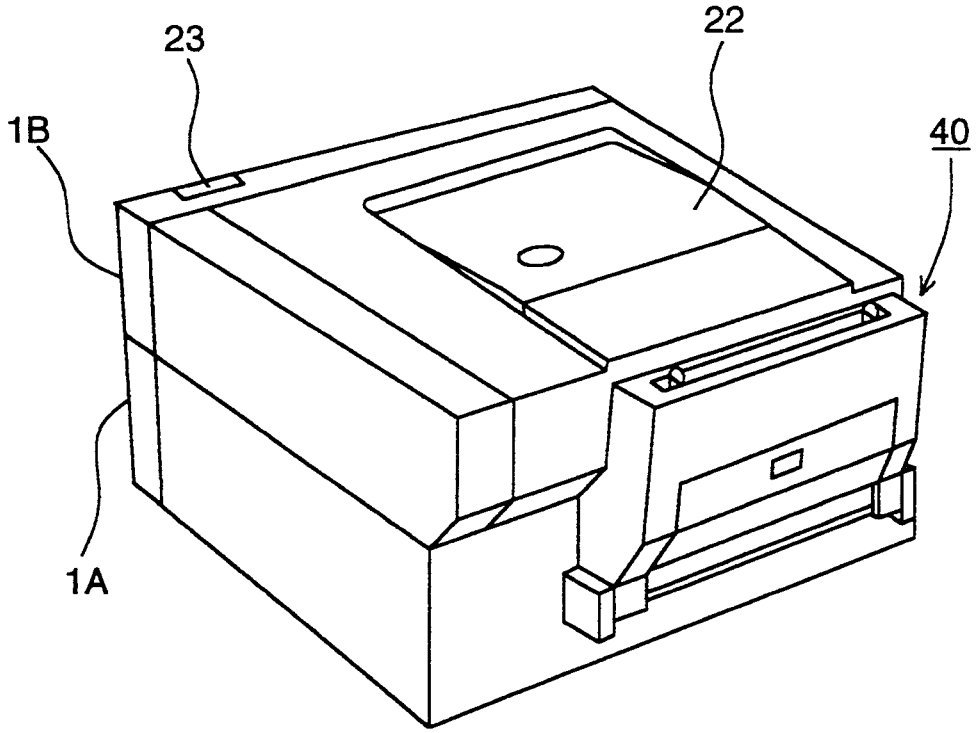
FIG. 3 is a perspective view on the rear side of the above-mentioned image recording apparatus.

FIG. 1 represents a side sectional view of an image recording apparatus equipped with a manual insertion sheet-feeding device, and the left end of the figure is a front side of the apparatus main body that faces an operator. The upper framework 1B can pivot around the center of the pivotal shaft 1C, which means that the front side of the main body can be opened widely. This image recording apparatus is of a front loading sheet-feeding type wherein the sheet-feeding cassette 3 can be loaded and unloaded through the front side of the main body on which operation/display panel 23 is provided. FIG. 2 is a perspective view of the front side of the image recording apparatus mentioned above and FIG. 3 is a perspective view of the rear side thereof.

On the back side of the image recording apparatus mentioned above, there is mounted manual insertion sheet-feeding device 40 of the invention. A sheet-ejection portion for a recording sheet of the manual insertion sheet-feeding device 40 is connected with the upstream side of guide plate 7C of the conveyance path for a recording sheet formed on the boundary plane between the lower framework 1A and the upper framework 1B.

Figure 4:
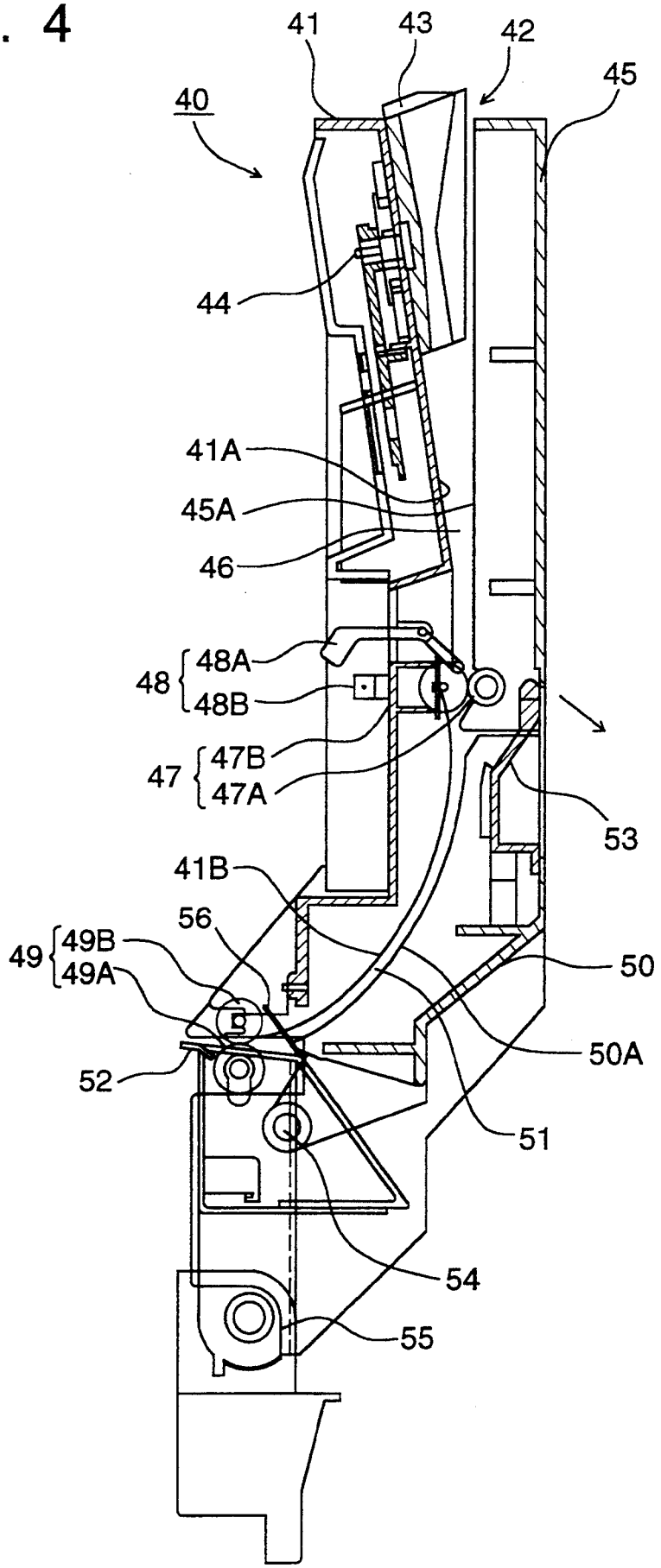
FIG. 4 is a side sectional view of a manual insertion sheet-feeding device.
Figure 5:
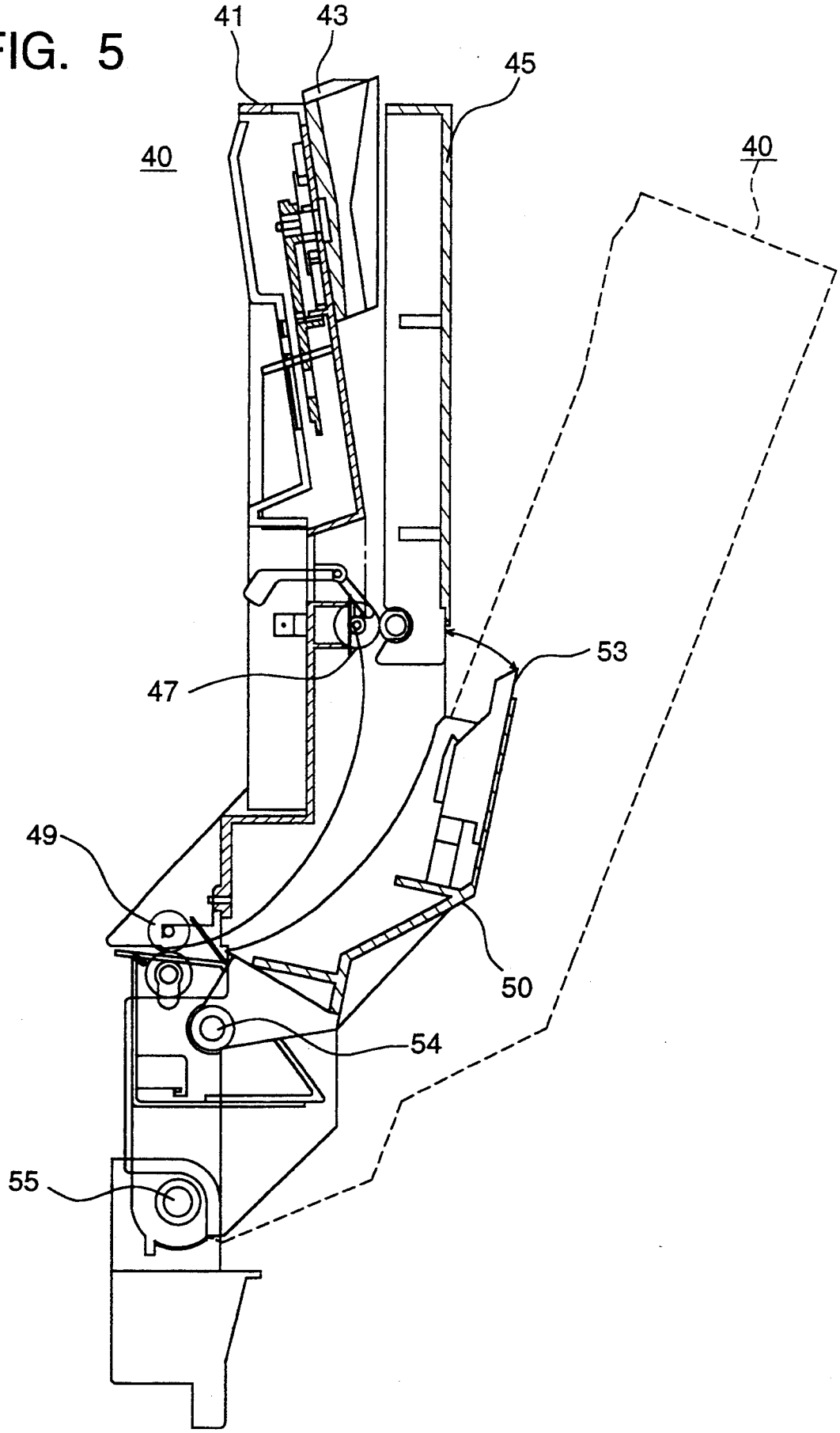
FIG. 5 is a side sectional view of the above-mentioned manual insertion sheet-feeding device whose cover is opened.

FIG. 4 is a side sectional view of the manual insertion sheet-feeding device 40, and FIG. 5 is a side sectional view wherein cover 50 is opened for the internal inspection in the case of jam clearance.

Above stationary frame body 41 of the manual insertion sheet-feeding device 40, there is provided opening 42 through which a recording sheet is inserted manually, and recording sheets can be inserted and dropped almost vertically through the opening 42.

In the vicinity of the opening 42, there is provided sheet-width-regulating plate 43 so that it may move in the direction of a sheet width. When operating the sheet-width-regulating plate 43 manually, rack/pinion mechanism 44 moves relatively to regulate the width of a sheet to be used according to the size of a sheet to be used.

Further, under the opening 42, there is formed guide path 46 for sheet feeding that is an inclined clearance formed between stationary guide wall 41A having an inclination angle and a plurality of ribs 45A provided inside stationary frame body 45 that faces the stationary guide wall 41A. Under the guide path 46, driving roller 47A connected to the driving source and driven roller 47B urged by a spring form a pair of feeding rollers 47 both of which are in pressure contact. In the vicinity of the pair of feeding rollers 47, there is provided sheet-passage-detection means 48 composed of actuator 48A and sensor 48B.

At the position which is further downstream the pair of feeding rollers 47 in terms of sheet feeding, there is formed sheet-feeding path 51 between a plurality of ribs 41B which are formed inside the stationary frame body 41 and a plurality of ribs 50A which are formed inside cover 50.

At the downstream side on the sheet-feeding path 51, there are a pair of sheet-ejection rollers 49 composed of driving roller 49A and driven roller 49B which are in pressure contact rotatably. The driving roller 49A is driven to rotate by an unillustrated motor. The motor drives also the driving roller 47A to rotate through an unillustrated power transmission means.

Sheet ejection guide plate 52 located at the downstream side of the pair of sheet-ejection rollers 49 faces an entrance portion of manual insertion sheet-feeding guide plate 24 of the lower framework 1A of the image recording apparatus.

Figure 6:
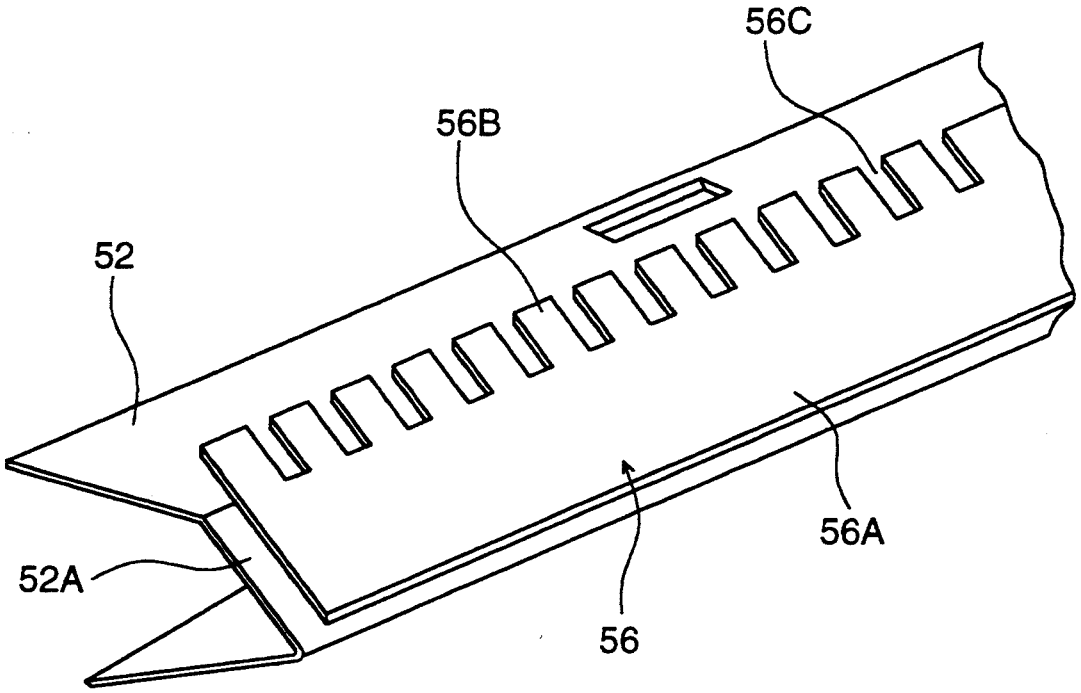
FIG. 6 represents partial perspective views of a sheet-ejection-guide plate and a gate member of the aforementioned manual insertion sheet-feeding device.

FIG. 6 shows partial perspective views of the sheet ejection guide plate 52 and gate member 56.

On inclined plane 52A of the sheet-ejection guide plate 52, there is glued base surface 56A of gate member (stopper member) 56 made of a flexible film. Tip 56B of the gate member 56 is protruded so that it may intercept the upstream side of the pair of sheet-ejection rollers 49 from the lower portion of the sheet-feeding path 51.

The gate member 56 is made of a flexible film such as, for example, polyethylene terephthalate (PET). A plurality of cut outs 56C are formed on the tip 56B of the gate member 56, and the cutouts 56C engage with a plurality of ribs 41B of the stationary frame body 41, thus the tip 56B engage with the ribs 41B to intercept the sheet-feeding path 51.

When a leading edge of the recording sheet P fed by pair of feeding rollers 47 located at the upper portion of the manual insertion sheet-feeding device 40 and conveyed downward after passing through the sheet-feeding path 51 hits the tip 56B of the gate member 56, the tip of the gate member 56 is subjected to elastic deformation and bends downward due to the force of conveying the recording sheet P to be conveyed and the stiffness of the recording sheet P. Thus, the sheet-feeding path 51 is opened, and the recording sheet P pushes the tip 56B of the gate member 56 aside to advance and enters a nip portion of the pair of sheet-ejection rollers 49.

When light weight foreign items such as clips, pins or staples fall in sheet-feeding guide path 46 from the opening 42 at the uppermost position that is opened when the recording sheet is not conveyed, these foreign items pass between roller shafts of the pair of feeding rollers 47, slide down the sheet-feeding path 51 formed between ribs 41B and 51A, run against the tip 56B of the gate member 56 intercepting the lower portion of the sheet-feeding path 51 and stop, and further slide down along the inclined surface of the base surface 56A of the gate member 56 in the direction shown with arrow B of dotted lines.

Opening 57 is formed below the outlet of the sheet-feeding path 51 and at the lower portion of the cover 50. Foreign items separated by the gate member 56 to slide down fall from the opening 57 outside the manual insertion sheet-feeding device 40.

Incidentally, the gate member 56 in the example is made of a flexible film. The invention, however, is not limited to the example, and the gate member may also be a spring-urged lever member which is held under the stationary frame body 41 to be capable of swiveling.

When feeding a recording sheet through manual insertion by means of manual insertion sheet-feeding device 40 of the invention, following operations are conducted.

(1) An operator standing on the front side of an image recording apparatus operates sheet-width-regulating plate 43 located in the vicinity of opening 42 on the manual insertion sheet-feeding device 40 on the rear side of the image recording apparatus, and sets it to the width corresponding to the size of the recording sheet to be inserted manually.

(2) When the recording sheet P to be inserted is inserted to be dropped along the inside of the sheet width regulating plate 43, passage of the leading edge of the recording sheet P is detected by the sheet passage detecting means 48, and the recording sheet P stops near the nip position of the pair of feeding rollers 47 to be on standby for sheet-feeding.

(3) Then, the signal for the start of sheet-feeding coming from the image recording apparatus starts an unillustrated motor to run, thereby driving rollers 47A and 49A are driven to rotate, and the recording sheet P being on standby starts being fed by the rotating pair of feeding rollers 47 to be fed downward. The recording sheet P passes through the sheet-feeding path 51, changes its advancing direction almost perpendicularly while bending, and is nipped by the rotating pair of sheet-ejection rollers 49 to be ejected from the device 40 through sheet-ejection guide plate 52. Then it passes through the guide plate 24 of the lower frame body 1A, and it further passes through the guide plate 7C to arrive at registration roller 9 to be on standby there. After that, image forming process control signals cause the recording sheet P to be conveyed to the image forming section.

(4) Next, when jamming takes place on the sheet-feeding path 51 of the manual insertion sheet-feeding device 40 due to the sheet-feeding trouble, locking claw member 53 located above the cover 50 is pushed down to release locking and thereby to rotate the cover 50 in the arrowed direction around the center of pivotal axis 54 so that the sheet-feeding path 51 may be opened. FIG. 5 is a sectional view of the manual insertion sheet-feeding device 40 wherein the cover 50 is opened. Incidentally, when sheet-feeding trouble happens between pair of sheet-ejection rollers 49 and registration roller 9, the manual insertion sheet-feeding device 40 is totally rotated around the center of the pivotal axis 55 in the direction to leave the upper frame body 1B. When the clearance is large as shown in FIG. 5, it is possible to remove the jammed recording sheet P easily. Under this opened state, cover 36 of toner supply unit 35 can be opened widely.

As stated above, the manual insertion sheet-feeding device of the invention is mounted almost vertically on the rear side of an image recording apparatus main body. Therefore, the image recording apparatus totally requires less floor space, and it can be installed in the narrow place.

Further, when an operator inserts a recording sheet in the manual insertion sheet-feeding device, the operator has only to insert the recording sheet along the sheet-width-regulating plate of the opening which is visible on the top of the manual insertion sheet-feeding device, while keeping standing on the front side of the image recording apparatus, so that the recording sheet may fall due to its own weight. Therefore, sheet-feeding is easy and reliable, requiring neither movement of the sheet-feeding device nor operation at the rear side of the apparatus, which means excellency in easy operation.

As stated above, in the manual insertion sheet-feeding device of the invention, even when foreign items such as clips or the like fall in the sheet-feeding path of the sheet-feeding device, these foreign items are separated by a gate member from the sheet-feeding path and ejected out of the sheet-feeding device. Therefore, it is possible to prevent an occurrence of troubles on the sheet-feeding device and sheet-feeding troubles for the recording sheet.

An example achieving the third object of the invention will be explained as follows, referring to illustrations.

Figure 7:
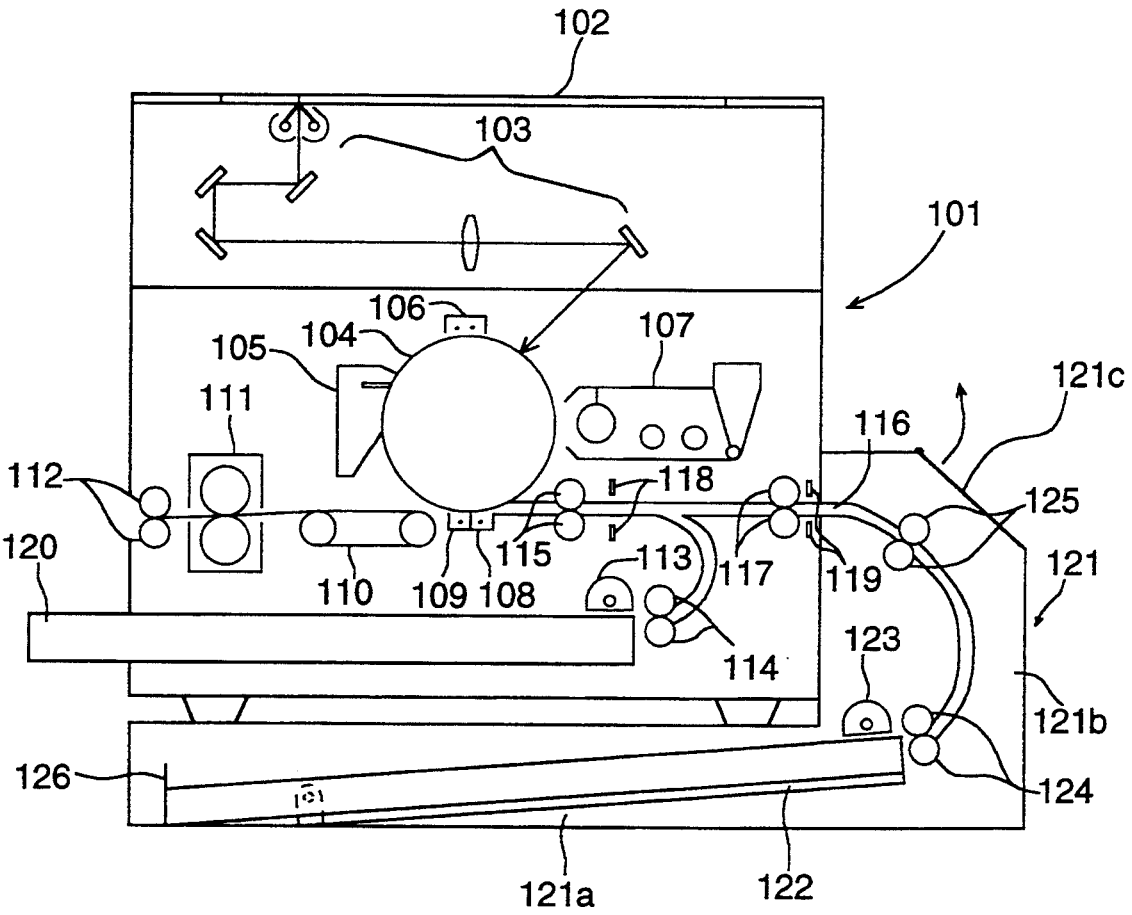
Figure 8:
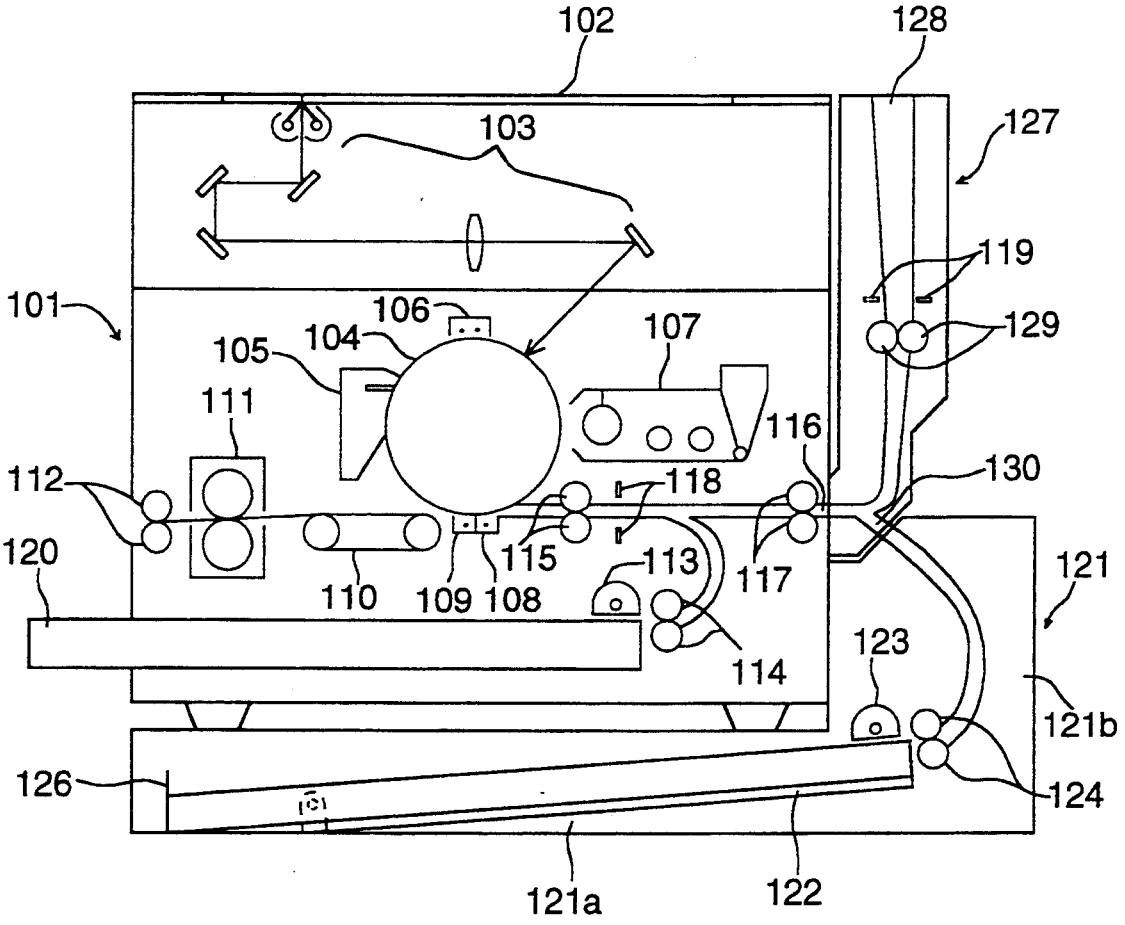
FIG. 8 is a general schematic sectional view showing an example of an image recording apparatus attaining the third object of the invention.

Each of FIG. 7 and FIG. 8 is a general schematic section showing an example of the image recording apparatus of the invention. In the figures, the numeral 101 represents an image recording apparatus main body, 102 is a platen, 103 is a scanning exposure device which scans a document placed on the platen 102 for exposure and sends reflected light to photoreceptor drum 104 rotating in the arrowed direction, 105 is a cleaning unit that removes remaining toner from the surface of the photoreceptor drum 104, the numeral 106 is a charging unit that charges with electricity uniformly the cleaned surface of the photoreceptor drum 104, 107 is a developing unit that develops an electrostatic latent image formed on the uniformly-charged surface of the photoreceptor drum 104 through the incidence of light from an image by means of the scanning exposure device 103, the numeral 108 is a transfer unit that transfers a toner image onto a recording sheet, 109 is a separating unit that separates the recording sheet from the surface of the photoreceptor drum 104, the numeral 110 is a conveyor that conveys the separated recording sheet to heat roller fixing unit 111, and the numeral 112 is an ejection roller that ejects the recording sheet on which the toner image has been fixed to the outside of the apparatus.

Image recording apparatus main body 101 of the illustration is equipped with two series of recording sheet supply paths. One of them is an automatic supply path for leading a recording sheet to a transfer unit through feed-out roller 113 that feeds out recording sheets loaded in sheet-feeding cassette 120 inserted in the main body 101 one sheet by one sheet, receive-transport roller 114 and registration roller 115, and the other is a manual insertion supply path for leading a recording sheet to a transfer unit through feed-in roller 117 for a recording sheet inserted in sheet-inlet for manual insertion 116 and registration roller 115.

The numerals 118 and 119 represent a sensor detecting the leading edge of a recording sheet, and information of their detection are used for detecting a jam of a recording sheet. However, in the primary utilization thereof, rotation of the receive-transport roller 114 and that of the feed-in roller 117 are stopped by the information of detection made by the sensor 118 and rotation of the feed-in roller 117 is started by the information of detection made by the sensor 119 so that the leading edge of the recording sheet may be brought into pressure contact with the registration roller 115. The constitution of the image recording apparatus main body 101 has hitherto been known.

The numeral 121 is a recording sheet feeding stand on which the image recording apparatus main body 101 may be placed as shown in the figure. The lower portion thereof serves as recording sheet container **121*a* equipped with sheet-feeding tray 122, while, the portion located outside on the side where the sheet-inlet for manual insertion 116 of the image recording apparatus main body 101 is opened serves as recording sheet feed-out section 121***b* equipped with sheet-feed-out roller 123 that feeds out recording sheets into the sheet-feeding tray 122 one sheet by one sheet, receive-transport roller 124 and further with, in the example in FIG. 7, relay roller 125. The numeral 126 is a position-adjustable rear stopper plate that is positioned on the sheet-feeding tray 122 and supports the trailing edge of the recording sheet, and recording sheets are loaded on the sheet-feeding tray 122 from the left side in the figure or from this side on the figure plane.

In an example shown in FIG. 8, there is provided manual insertion device 127 which enables a recording sheet to be dropped vertically for insertion on the side where the sheet-inlet for manual insertion 116 of the image recording apparatus main body 101 is opened, and when the leading edge of the recording sheet inserted through sheet-inlet 128 thereof is detected by the sensor 119, both the feed-in roller 117 of the image recording apparatus main body 101 and the feed-in roller 129 of the manual insertion device 127 start rotating. Then, the inserted recording sheet is fed by the feed-in roller 117 from the sheet-inlet for manual insertion 116 to the registration roller 115. Further, the manual insertion device 127 is equipped with receiving opening 130 that receives the recording sheet coming from the recording sheet feeding stand 121 and leads it to the sheet-inlet for manual insertion 116.

When the image recording apparatus main body 101 is placed correctly on the recording sheet feeding stand 121, the recording sheet fed out of the recording sheet feed-out section 121*b* of the recording sheet feeding stand 121 can be fed into the sheet-inlet for manual insertion 116 of the image recording apparatus main body 101 in both examples in FIG. 7 and FIG. 8. After the image recording apparatus main body 101 is placed on the recording sheet feeding stand 121, both of them are to be connected by an unillustrated signal power communication cable. Thereby, the feed-out roller 123, the receive-transport roller 124, or further the relay roller 125 on the recording sheet feeding stand 121 are controlled by a control device to be driven, similarly to the feed-out roller 113 and the receive-transport roller 114 on the image recording apparatus main body 101. As a result, the image recording apparatus becomes equivalent to one having two series of automatic sheet supply paths. In this case, the feed-in roller 117 of the sheet-inlet for manual insertion 116 rotates synchronizing with the receive-transport roller 124 and the relay roller 125 on the recording sheet feeding stand 121.

In the example shown in FIG. 7, since it is impossible to insert a sheet manually, top plate portion 121*c* of the recording sheet feed-out section 121*b* on the recording sheet feeding stand 121 is made to be opened in the arrowed direction, and a sensor that detects the opening of the top plate portion 121*c* is provided, so that it may be possible to insert a sheet manually even when the image recording apparatus main body 101 is combined with the recording sheet feeding stand 121, by causing the information of detection made by the sensor to act so that the condition of no connection with the cable mentioned above may be created and the recording sheet may be inserted in the sheet-inlet for manual insertion 116 from the opened position of the top plate portion 121*c*.

The invention may be applied either to one wherein an image recording apparatus main body conducts imagewise exposure by means of a laser beam scanner for forming color images or to one wherein the recording sheet feeding stand employs a sheet-feeding cassette.

The present invention offers remarkable effect that the production quantity of an image recording apparatus equipped with a sheet-inlet for manual insertion is increased and thereby the production cost is reduced, a sheet-inlet for manual insertion can be used in the case of an image recording apparatus main body alone, and the sheet-inlet for manual insertion can be used frequently in the case of a combination of the image recording apparatus main body and the recording sheet feeding stand.

What is claimed is:

1. An apparatus for forming an image on a recording sheet comprising a casing;

an image former disposed in said casing;

a conveyor for moving a sheet through a sheet passage to said image former so that said sheet receives an image thereon from said image former, said sheet passage positioned at a lower portion of said casing;

a manual sheet-feeder for manually feeding a sheet to said apparatus, said sheet-feeder being mounted on a side of said casing, there being an entrance for said manual feeder at the top of said casing, a manual sheet-feeder passage extending downwardly from said entrance and connected to said sheet passage through which a manually-fed sheet is conveyed to the image former, a gate member adapted to block said manual sheet-feeder passage to prevent a foreign substance entering said manual sheet-feeder passage and from entering said sheet passage.

2. The apparatus of claim 1, wherein the gate member is arranged to discharge the foreign substance to the outside of the manual sheet-feeding passage.

3. The apparatus of claim 1, wherein the gate member is elastically biased to the block position so that, when the sheet comes to the gate member from the manual sheet-feeding entrance, the gate member is displaced so as to allow the sheet to proceed to the sheet passage.

* * * * *